US005391131A

United States Patent [19]

Gordon

[11] Patent Number: 5,391,131

[45] Date of Patent: Feb. 21, 1995

[54] SNOW SKI ENHANCER

[76] Inventor: Kirk L. Gordon, 11 Craney Hill Rd., Weare, N.H. 03281

[21] Appl. No.: 240,175

[22] Filed: May 9, 1994

[51] Int. Cl.[6] ..... A63B 22/20; A63B 23/04

[52] U.S. Cl. ..... 482/71; 482/51; 482/74

[58] Field of Search ..... 482/51, 52, 54, 70, 482/71, 68, 148, 74; 434/254

[56] References Cited

U.S. PATENT DOCUMENTS

| | | | |
|---|---|---|---|
| 4,216,956 | 8/1980 | Yamamura et al. | 482/51 |
| 4,744,576 | 5/1988 | Scollan | 482/71 |
| 4,772,014 | 9/1988 | Rebman | 482/51 |
| 5,232,423 | 8/1993 | Hajduczek | 482/68 |

*Primary Examiner*—Stephen R. Crow

[57] ABSTRACT

A new and improved snow ski enhancer comprised of a weighted base having a front side, a back side, a left sidewall, a right sidewall, an upper surface and a lower surface. The front side has a lower bottom edge and an upper top edge. The upper surface is concave. The upper concave surface has a height ranging between three and five inches at the left sidewall. A height ranging between three and five inches at the right sidewall. A height ranging between two and three inches therebetween. The front side of the weighted base is inclined from the lower bottom edge to the upper top edge. Two hollow cylindrical vertical extensions are integral with the back side of the weighted base. The device contains a foam cushion having a top surface and a bottom surface. The bottom surface is secured to the upper concave surface of the weighted base. Three foot position markers are positioned on the top surface of the foam cushion. The foam cushion has a width ranging between two and three inches. The device contains a U-shaped piece having two lower legs and an intermediate extent therebetween. The two lower legs are adapted to be secured within the two hollow cylindrical vertical extensions of the weighted base. Two hand grips are located on the intermediate extent of the U-shaped piece.

4 Claims, 4 Drawing Sheets

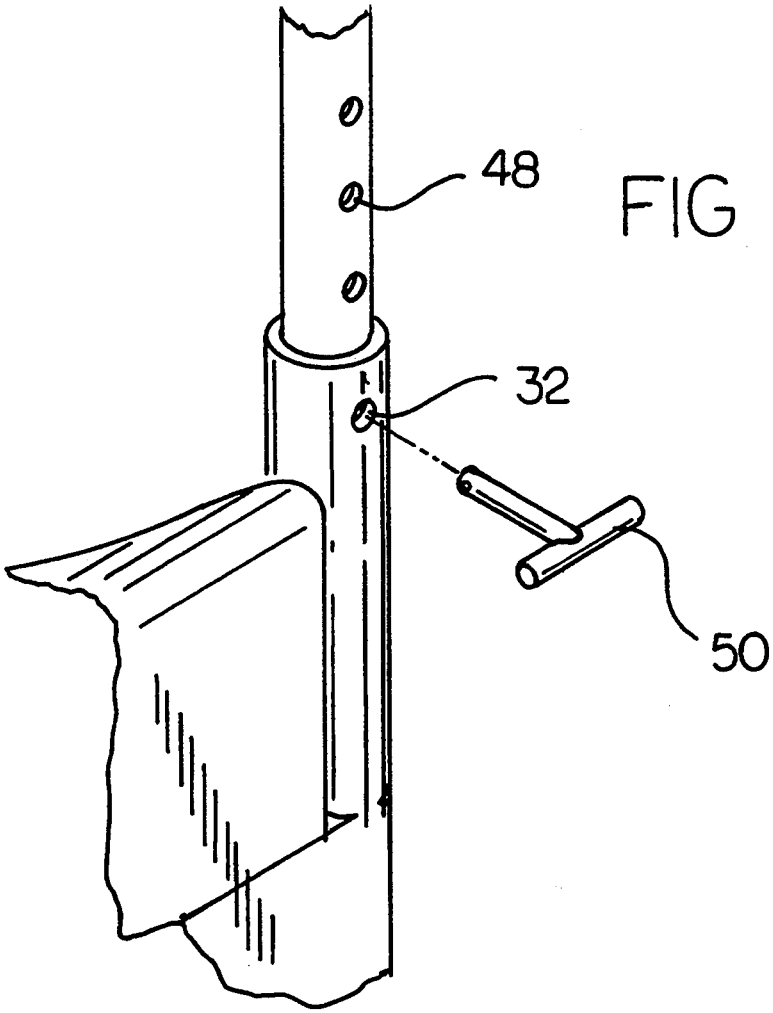
FIG 5
FIG 6
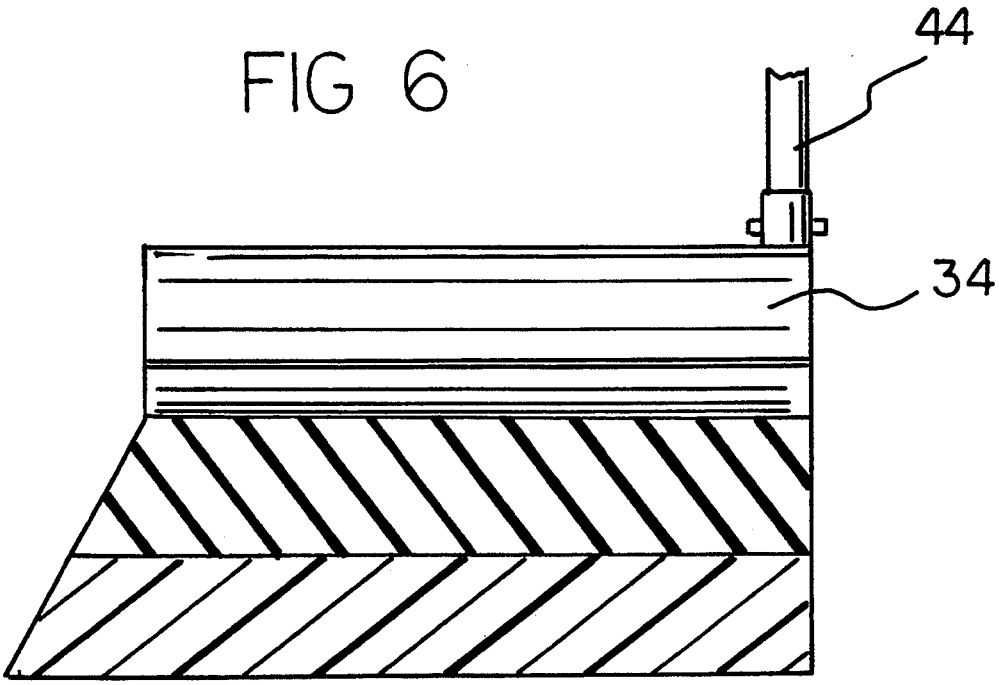

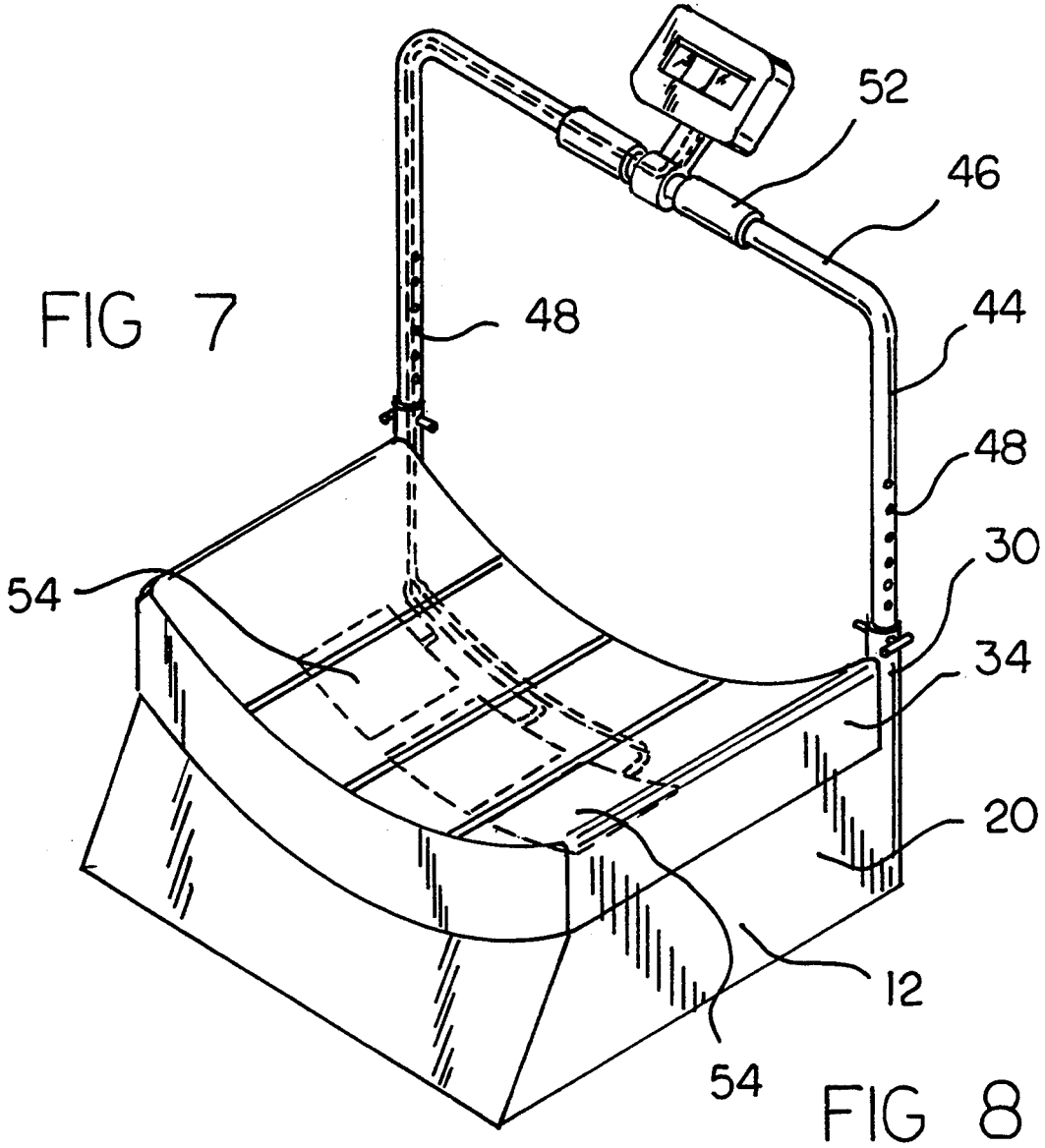
FIG 7
FIG 8
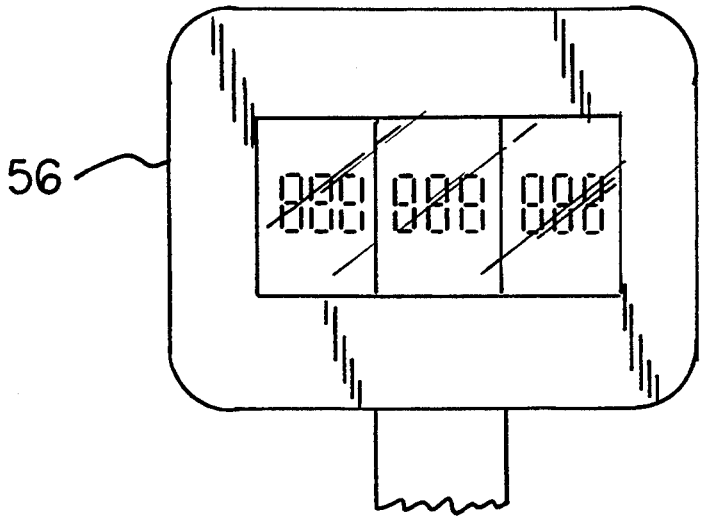

SNOW SKI ENHANCER

BACKGROUND OF THE INVENTION

1. Field of the Invention

The present invention relates to a snow ski enhancer and more particularly pertains to strengthening the skiing muscles and increasing endurance.

2. Description of the Prior Art

The use of exercise apparatuses is known in the prior art. More specifically, exercise apparatuses heretofore devised and utilized for the purpose of exercising are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 5,147,257 to Loane a ski exercising apparatus.

U.S. Pat. No. 5,145,481 to Friedbach discloses a ski exercise machine that is designed for aesthetic appearance as well as function and utility in exercising.

U.S. Pat. No. 5,108,093 to Watterson discloses a multipurpose exerciser.

U.S. Pat. No. 4,960,276 to Fener discloses a cross country ski exercise apparatus for closely simulating cross country skiing.

U.S. Pat. No. 4,744,558 to Smirmaul discloses a downhill ski exercise device.

In this respect, the snow ski enhancer according to the present invention substantially departs from the conventional concepts and designs of the prior art, and in doing so provides an apparatus primarily developed for the purpose of strengthening the skiing muscles and increasing endurance.

Therefore, it can be appreciated that there exists a continuing need for a new and improved snow ski enhancer which can be used for strengthening the skiing muscles and increasing endurance. In this regard, the present invention substantially fulfills this need.

SUMMARY OF THE INVENTION

In view of the foregoing disadvantages inherent in the known types of exercise apparatuses now present in the prior art, the present invention provides an improved snow ski enhancer. As such, the general purpose of the present invention, which will be described subsequently in greater detail, is to provide a new and improved snow ski enhancer and method which has all the advantages of the prior art and none of the disadvantages.

To attain this, the present invention essentially comprises a snow ski enhancer having a weighted base having a front side, a back side, a left sidewall, a right sidewall, an upper surface and a lower surface. The front side has a lower bottom edge and an upper top edge. The upper surface is concave. The weighted base has a width of about five feet and a depth of about twenty inches. The upper concave surface has a height of about five inches at the left sidewall and at the right sidewall and a height of about three inches therebetween. The front side of the weighted base is inclined from the lower bottom edge to the upper top edge. Two hollow cylindrical vertical extensions are integral with the back side of the weighted base. An aperture is formed in each of the two hollow vertical extensions. The device contains a foam cushion having a top surface and a bottom surface. The bottom surface is secured to the upper concave surface of the weighted base. A plurality of foot position markers are positioned on the top surface of the foam cushion. The foam cushion has a width of about three inches. The device contains a U-shaped piece having two lower legs and an intermediate extent therebetween. A plurality of apertures are formed along the two lower legs. The two lower legs are adapted to be received within the two hollow cylindrical vertical extensions of the weighted base. The plurality of apertures of the two lower legs are adapted for registration with the apertures formed in the two hollow cylindrical vertical extensions of the weighted base. A fastening means cooperates with the apertures of the two lower legs and the apertures of the hollow cylindrical vertical extensions. The fastening means functions to secure the two lower legs relative to the hollow cylindrical vertical extensions. The fastening means is removable allowing the U-shaped piece to adjust from about 32 inches to about 48 inches in height. Two hand grips are located on the intermediate extent of the U-shaped piece.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved snow ski enhancer which has all the advantages of the prior art exercise apparatuses and none of the disadvantages.

It is another object of the present invention to provide a new and improved snow ski enhancer which may be easily and efficiently manufactured and marketed.

It is further object of the present invention to provide a new and improved snow ski enhancer which is of durable and reliable constructions.

An even further object of the present invention is to provide a new and improved snow ski enhancer which is susceptible of a low cost of manufacture with regard to both materials and labor, and which accordingly is then susceptible of low prices of sale to the consuming public, thereby making such a snow ski enhancer economically available to the buying public.

Still yet another object of the present invention is to provide a new and improved snow ski enhancer which provides in the apparatuses and methods of the prior art some of the advantages thereof, while simultaneously overcoming some of the disadvantages normally associated therewith.

Even still another object of the present invention is to strengthen the skiing muscles and increase endurance.

Lastly, it is an object of the present invention to provide a new and improved snow ski enhancer comprised of a weighted base having a front side, a back side, a left sidewall, a right sidewall, an upper surface and a lower surface. The front side has a lower bottom edge and an upper top edge. The upper surface is concave. The weighted base has a width ranging between about four to about six feet and a depth of between about fifteen and about twenty-five inches. The upper concave surface has a height ranging between about four and about six inches at the left sidewall. A height ranging between about four and about six inches at the right sidewall. A height ranging between about two and about four inches therebetween. The front side of the weighted base is inclined from the lower bottom edge to the upper top edge. Two hollow cylindrical vertical extensions are integral with the back side of the weighted base. The device contains a foam cushion having a top surface and a bottom surface. The bottom surface is secured to the upper concave surface of the weighted base. A plurality of foot position markers are positioned on the top surface of the foam cushion. The foam cushion has a width ranging between about two and about four inches. The device contains a U-shaped piece having two lower legs and an intermediate extent therebetween. The two lower legs are adapted to be secured within the two hollow cylindrical vertical extensions of the weighted base. Two hand grips are located on the intermediate extent of the U-shaped piece.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is an enlarged view of the fastening means used to secure the U-shaped piece with the weighted base.

FIG. 6 is a cross-sectional view of the present invention and is a view taken along line 6—6 of FIG. 1.

FIG. 7 is a perspective view of the present invention including the second embodiment.

FIG. 8 is a front view of the second embodiment of the present invention.

The same reference numerals refer to the same parts through the various Figures.

DESCRIPTION OF THE PREFERRED EMBODIMENT

Figure 1:
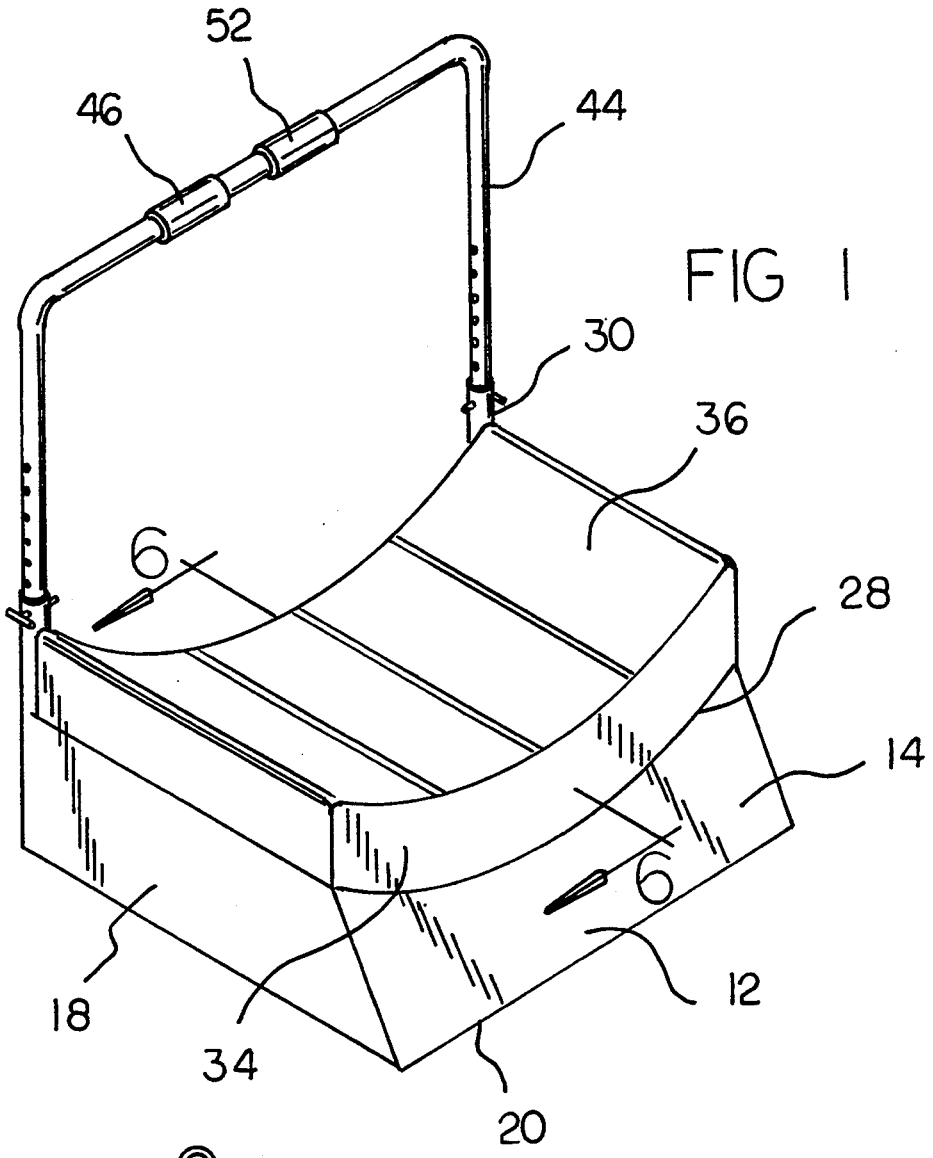
FIG. 1 is a perspective view of the preferred embodiment of the snow ski enhancer constructed in accordance with the principles of the present invention.
Figure 2:
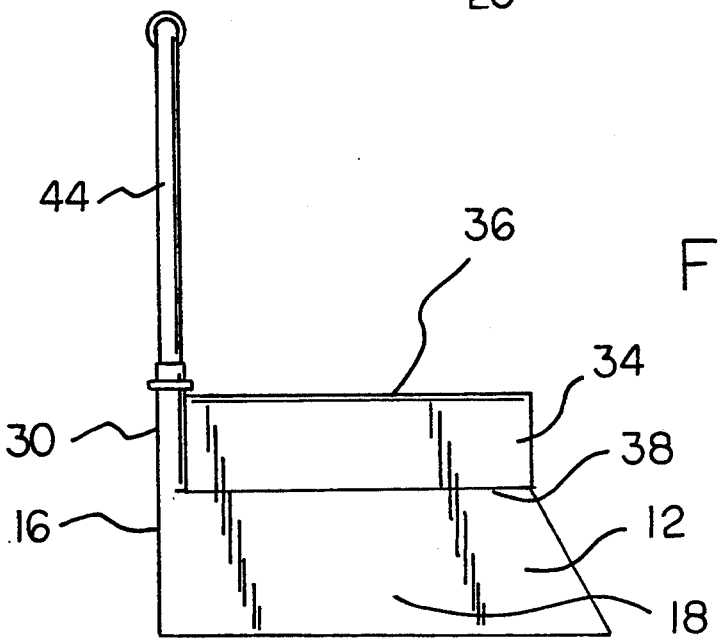
FIG. 2 is a side view of the invention in accordance with the principles of the present invention.
Figure 3:
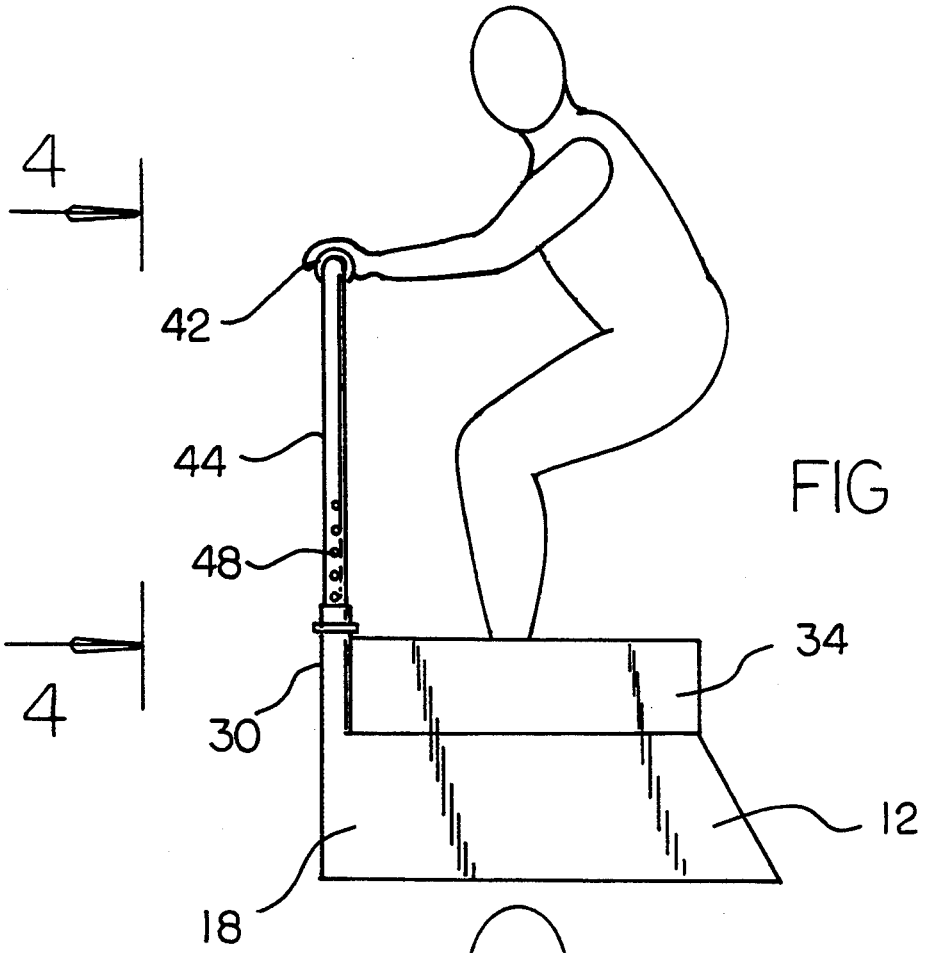
FIG. 3 is a side view of the invention in accordance with the principles of the present invention.
Figure 4:
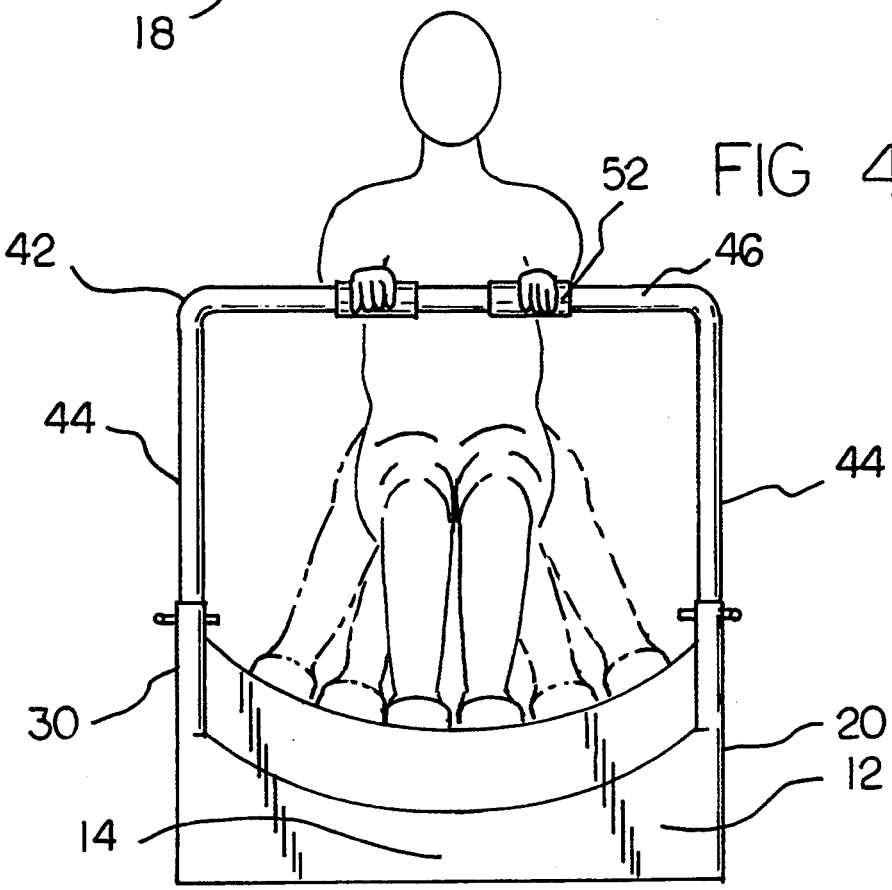
FIG. 4 is a front view of the present invention and is a view taken along line 4—4 of FIG. 3.

With reference now to the drawings, and in particular to FIG. 1 thereof, the preferred embodiment of the new and improved snow ski enhancer embodying the principles and concepts of the present invention and generally designated by the reference numeral 10 will be described.

More specifically, it will be noted in the various Figures that the device relates to a snow ski enhancer. In it's broadest context, the device contains a weighted base, a foam cushion, a U-shaped piece, a pressure sensor, and a counter.

The device 10 contains a weighted base 12 having a front side 14, a back side 16 , a left sidewall 18, a right sidewall 20, an upper surface 22 and a lower surface 24. The front side 14 has a lower bottom edge 26 and an upper top edge 28. The upper surface 22 is concave. The weighted base 12 has a width ranging between about four and about six feet. In the preferred embodiment, the weighted base 12 has a width of about five feet and a depth of about twenty inches. The upper concave surface 22 has a height ranging between about four and about six inches at the left sidewall 18 and the right sidewall 20 and a height ranging between about two and about four inches therebetween. In the preferred embodiment, the upper concave surface 22 has a height of about five inches at the left sidewall 18 and at the right sidewall 20 and a height of about three inches therebetween. The front side 14 of the weighted base 12 is inclined from the lower bottom edge 26 to the upper top edge 28. Two hollow cylindrical vertical extensions 30 are integral with the back side 16 of the weighted base 12. An aperture 32 is formed in each of the two hollow vertical extensions 30. The device 10 contains a foam cushion 34 having a top surface 36 and a bottom surface 38. The bottom surface 38 is secured to the upper concave surface 22 of the weighted base 12. A plurality of foot position markers 40 are positioned on the top surface 36 of the foam cushion 34. The foam cushion 34 has a width ranging between about two and about four inches. In the preferred embodiment, the foam cushion 34 has a width of about three inches. The device 10 contains a U-shaped piece 42 having two lower legs 44 and an intermediate extent therebetween 46. A plurality of apertures 48 are formed along the two lower legs 44. The two lower legs 44 are adapted to be received within the two hollow cylindrical vertical extensions 30 of the weighted base 12. The plurality of apertures 48 of the two lower legs 44 are adapted for registration with the apertures 32 formed in the two hollow cylindrical vertical extensions 30 of the weighted base 12. A fastening means 50 cooperates with the apertures 48 of the two lower legs 44 and the apertures 32 of the hollow cylindrical vertical extensions 30. The fastening means 50 functions to secure the two lower legs 44 relative to the hollow cylindrical vertical extensions 30. The fastening means 50 is removable allowing the U-shaped piece 42 to adjust from about 32 inches to about 48 inches in height. Two hand grips 52 are located on the intermediate extent 46 of the U-shaped piece 42.

A pressure sensor 54 is secured within the foam cushion 34. The pressure sensor 54 corresponds to the three foot position markers 40. The pressure sensor 54 functions to count the number of hops absorbed on the foam cushion 34 at each of the three foot position markers 40. A counter 56 is secured to the intermediate extent 46 of the U-shaped piece 42. The counter 56 cooperates with the pressure sensor 54 to display the number of hops absorbed on the foam cushion 34 at each of the three foot position markers 40.

Skiing is a very popular sport in many parts of the world where the climate allows. There are two main types of snow skiing: downhill and cross-country.

The technicalities of skiing are complex, but the primary need for the average skier, as well as the expert, is control. It is not sufficient or safe to ski downhill at full speed on a straight course. To enjoy the sport it is necessary to be able to check speed, to stop, and to make turns in order to avoid obstacles.

The basic type of downhill skiing today embraces a crouched style with a forward lean. The primary objective of casual skier is to enjoy his downhill glide and to reach the bottom safely. The skier should be able to stop or turn. Checks and turns of the snowplow and stem variety, with the ski tips closes together and the heels far apart, are the most elementary. For more experienced skiers there are varieties where skis are parallel, and weight shift and body rotation are used. The present invention is exercise equipment that prepares a skier for downhill skiing.

The present invention is made from steel, plastic, and foam rubber. It has a weighted base that is 4 to 5 feet wide, 20 inches deep, and approximately 2 to 3 inches thick at the center, sloping to about 4 to 5 inches thick at the edges. Installed over the base is a foam cushion that is approximately 2 to 3 inches thick. Plastic PVC pipe extends up from the base on both sides and is connected to a top horizontal PVC pipe that is perpendicular to the two vertical pipes. Two hand grips are located on the horizontal pipe, positioned on either side of its middle. The two vertical pipes can be adjusted vertically from 32 to 48 inches high. There are three foot positions marked on the foam rubber cushion, one in the center and one on either side of and equally spaced from the center.

To use the present invention, the user stands on the foam cushion in the center foot position, places their hands over the two hand grips on the intermediate extent of the U-shaped piece, bends their knees as if skiing, hops to the right foot position, hops to the left foot position, and back to the right foot position, and so on, imitating the skiing movement. The exercise, done frequently, will strengthen the skiing muscles and increase the skier's endurance, thus preparing them for the actual skiing season.

The present invention could be a valuable acquisition for any skiing enthusiast who enjoys downhill skiing.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved snow ski enhancer comprising, in combination:

a weighted base having a front side, a back side, a left sidewall, a right sidewall, an upper surface and a lower surface, the front side having a lower bottom edge and an upper top edge, the upper surface being concave, the weighted base having a width of about five feet and a depth of about twenty inches, the upper concave surface having a height of about five inches at the left sidewall, a height of about five inches at the right sidewall, and a height of about three inches therebetween, the front side of the weighted base being inclined from the lower bottom edge to the upper top edge, two hollow cylindrical vertical extensions integral with the back side of the weighted base, an aperture formed in each of the two hollow vertical extensions;

a foam cushion having a top surface and a bottom surface, the bottom surface secured to the upper concave surface of the weighted base, a plurality of foot position markers positioned on the top surface of the foam cushion, the foam cushion having a width of about three inches; and a U-shaped piece having two lower legs and an intermediate extent therebetween, a plurality of apertures formed along the two lower legs, the two lower legs adapted to be received within the two hollow cylindrical vertical extensions of the weighted base, the plurality of apertures of the two lower legs adapted for registration with the apertures formed in the two hollow cylindrical vertical extensions of the weighted base, a fastening means cooperating with the apertures of the two lower legs and the apertures of the hollow cylindrical vertical extensions, the fastening means functioning to secure the two lower legs relative to the hollow cylindrical vertical extensions, the fastening means being removable allowing the U-shaped piece to adjust from about 32 inches to about 48 inches in height, and two hand grips are located on the intermediate extent of the U-shaped piece.

2. A snow ski enhancer comprising:

a weighted base having a front side, a back side, a left sidewall, a right sidewall, an upper surface and a lower surface, the front side having a lower bottom edge and an upper top edge, the upper surface being concave, the weighted base having a width ranging between about four to about six feet and a depth of between about fifteen and about twenty-five inches, the upper concave surface having a height ranging between about four and about six inches at the left sidewall, a height ranging between about four and about six inches at the right sidewall, and a height ranging between about two and about four inches therebetween, the front side of the weighted base being inclined from the lower bottom edge to the upper top edge, two hollow cylindrical vertical extensions integral with the back side of the weighted base;

a foam cushion having a top surface and a bottom surface, the bottom surface secured to the upper concave surface of the weighted base, a plurality of foot position markers positioned on the top surface of the foam cushion, the foam cushion having a width ranging between about two and about four inches; and a U-shaped piece having two lower legs and an intermediate extent therebetween, the two lower legs adapted to be secured within the two hollow cylindrical vertical extensions of the weighted base, and two hand grips are located on the intermediate extent of the U-shaped piece.

3. A snow ski enhancer as described in claim 1 and further comprising:

a pressure sensor secured within the foam cushion, the pressure sensor corresponding to the plurality of foot position markers, the pressure sensor functioning to count the number of hops absorbed on the foam cushion at each of the three foot position markers; and a counter secured to the intermediate extent of the U-shaped piece, the counter cooperating with the pressure sensor to display the number of hops absorbed on the foam cushion at each of the three foot position markers.

4. The snow ski enhancer as described in claim 3 further comprising:

an aperture formed in each of the two hollow vertical extensions of the weighted base; and a plurality of apertures formed along the two lower legs of the U-shaped piece, the plurality of apertures of the two lower legs adapted for registration with the apertures formed in the two hollow cylindrical vertical extensions of the weighted base, a fastening means cooperating with the apertures of the two lower legs and the apertures of the hollow cylindrical vertical extensions, the fastening means functioning to secure the two lower legs relative to the hollow cylindrical vertical extensions, the fastening means being removable allowing the U-shaped piece to adjust from about 32 inches to about 48 inches in height.

* * * * *